US005553114A

United States Patent [19]

Siemers et al.

[11] Patent Number: 5,553,114

[45] Date of Patent: *Sep. 3, 1996

[54] EMISSIVE COATING FOR X-RAY TUBE ROTORS

[75] Inventors: Paul A. Siemers, Clifton Park, N.Y.; Richard W. Lindberg, Milwaukee, Wis.; Stephen F. Rutkowski, Duanesburg, N.Y.

[73] Assignee: General Electric Company, Schenectady, N.Y.

[ * ] Notice: The term of this patent shall not extend beyond the expiration date of Pat. No. 5,461,659.

[21] Appl. No.: 222,780

[22] Filed: Apr. 4, 1994

[51] Int. Cl.[6] ..... H01J 35/10

[52] U.S. Cl. ..... 378/129; 378/128; 378/144

[58] Field of Search ..... 378/119, 125, 378/128, 127, 129, 131, 132, 142, 144, 201

[56] References Cited

U.S. PATENT DOCUMENTS

| | | | |
|---|---|---|---|
| 3,919,124 | 11/1975 | Friedel et al. | 313/330 |
| 3,993,123 | 11/1976 | Chu et al. | 165/80 |
| 4,029,828 | 6/1977 | Bildstein et al. | 427/34 |
| 4,090,103 | 5/1978 | Machenschalk et al. | 313/330 |
| 4,132,916 | 1/1979 | Hueschen et al. | 313/330 |
| 4,516,255 | 5/1985 | Petter et al. | 378/143 |
| 4,935,948 | 6/1990 | Kim | 378/132 |
| 4,953,190 | 8/1990 | Kukoleck et al. | 378/129 |
| 5,150,397 | 9/1992 | Randzaao | 378/129 |
| 5,461,659 | 10/1995 | Siemers et al | 378/129 |

*Primary Examiner*—Dong Wong

*Attorney, Agent, or Firm*—R. Thomas Payne; William H. Pittman

[57] ABSTRACT

An improved high performance x-ray system having a rotating anode therein which includes an improved coating for the x-ray tube rotor. The surface of the x-ray tube rotor is coated with a ductile, metal coating, preferably iron, having a thickness of about 0.2 to about 5.0 mils thick. The rotor coating has ductile properties with a strain to fail greater than 0.05% and thermal expansion properties which when placed on an x-ray tube rotor, provides at least about 40,000 x-ray scan-seconds prior to tube failure due to rotor spalling.

31 Claims, 5 Drawing Sheets

EMISSIVE COATING FOR X-RAY TUBE ROTORS

RELATED APPLICATIONS

This application is related to a pending patent application Ser. No. 08/210,823 (RD-23,391), filed Mar. 18, 1994, the disclosure of which is hereby incorporated by reference.

BACKGROUND OF THE INVENTION

The present invention relates to equipment for diagnostic and therapeutic radiology and methods of making the same and, more particularly, to an emissive coating for x-ray tube rotors, such as those utilized in x-ray tubes.

One problem faced by x-ray tube designers has been related to the amount of heat generated during the x-ray generation cycle. Specifically, the silver lubricated bearings used with the anode rotor have, in the past, had a tendency to fail prematurely due to overheating from the tremendously high temperatures generated in the x-ray tube during peak power situations. Specifically, it is not uncommon for temperatures in the range of 700° C. to be generated in the vicinity of the silver lubricated bearing most proximate the rotating target. The problem related to rotor bearing overheating had been effectively solved utilizing an emissive coating on the anode rotor by plasma spraying a 0.001 inch thick oxygen deficient $TiO_2$ coating onto the rotor skirt.

With the recent tendency toward higher and higher power x-ray tubes and for nearly continuous twenty-four hour, seven day a week operations, another problem has developed with the anode rotor, that being material flaking from the surface of the rotor. This flaking or spallation of the brittle $TiO_2$ created fine particles that migrated to high electrical field regions of the tube, thus causing high voltage instabilities and arcing.

Recent GE autopsy results on certain x-ray tubes indicate that flaking of the rotor emissive coating is associated with about 62% of tube failures in the field. Thermal expansion studies of the plasma sprayed $TiO_2$ emissive coating used indicate that it begins sintering at temperatures as low as 350° C. and appears to shrink as much as 0.2% when heated to 800° C. It is believed that the brittle $TiO_2$ stress-relieves by sintering when it is exposed to its maximum operating temperature of about 700° C., and then fails compressively during thermal cycling.

Recently, the problem related to rotor flaking had reached a critical point. Due to the tremendous load stresses undergone by certain x-ray tubes during continuous operation, the average tubes life had been approximately 28,000 scan-seconds, utilizing the old $TiO_2$ rotor coating. Since an approximate 28,000 scan-second life did not even approach the 50,000 scan-second life per x-ray tube warranty and approximately 60% of the failures were due to flaking of the anode rotor, the need for an improved rotor having a coating that would eliminate the flaking while maintaining the effectiveness of the thermal emissive properties became apparent. Such a rotor coating composition desirably would provide sufficient thermal protection for the bearings and have sufficient emissive characteristics, while reducing significantly, if not eliminating, entirely flaking of the rotor coating such that the average x-ray tube life would more closely approach the guaranteed 50,000 scan-seconds life warranty.

SUMMARY OF THE INVENTION

In carrying out the present invention in preferred forms thereof, we provide an improved x-ray tube rotor emissive coating for use in x-ray tubes, such as those incorporated in diagnostic and therapeutic radiology machines, for example, computer tomography scanners. One illustrated embodiment of the invention disclosed herein, is in the form of an x-ray tube for the GE Zeus certain x-ray tube.

Each x-ray tube is normally enclosed in an oil-filled protective casing. A glass envelope contains a cathode plate, a rotating disk target and a rotor that is part of a motor assembly that spins the target. A stator is provided outside the tube proximate to the rotor and overlapping therewith about two-thirds of the rotor length. The glass envelope is enclosed in an oil-filled lead casing having a window for the x-rays that are generated to escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to in excess of hundreds of thousands of volts) between the anode (positive) and the cathode (negative) and impinge on the anode, whereby they are abruptly slowed down. The anode, usually referred to as the target, is often of the rotating disc type, so that the electron beam is constantly striking a different point on the anode perimeter. The x-ray tube itself is made of glass, but is enclosed in a protective casing that is filled with oil to absorb the heat produced. High voltages for operating the tube are supplied by a transformer (not shown) the alternating current is rectified by means of rectifier tubes (or "valves") in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

In one specific embodiment of the present invention, an x-ray tube comprising: an envelope; a cathode operatively positioned in the envelope; an anode assembly operatively positioned including a rotor in the envelope, the anode assembly a stator operatively positioned relative to, and a target, operatively positioned relative to the cathode the rotor comprising: an inner core; an outer core; and a ductile metal coating operatively positioned on the outer surface of the outer core at least about 40,000 x-ray scan-seconds are accomplished prior to tube failure due to rotor coating spalling is provided.

Another aspect of the present invention is embodied in an x-ray system comprising; an enclosure having oil contained therein; an oil pump, operatively positioned relative to the enclosure for circulating oil within the system; at least one cooling means, operatively connected to the enclosure and the oil pump, for cooling the oil; an x-ray tube, operatively positioned inside the enclosure, for generating the x-rays, the x-ray tube comprising: a glass envelope; a cathode, operatively positioned in the glass frame; an anode assembly including a rotor and a stator, operatively positioned relative to the rotor; and a target, operatively positioned relative to the cathode and the anode assembly, the rotor comprising: a steel inner core; a copper outer core; and a ductile, metal thermal emissive coating operatively covering the outer surface of the copper outer core at.

In one specific embodiment of the present invention, the ductile metal coating comprises: iron a strong, ductile, highly adherent (to copper) metal whose oxides are emissive and are stable in the x-ray tube environment.

In another specific embodiment of the present invention, the ductile coating comprises: iron coating from about 0.25 to about 5.0 mils thick.

In another specific embodiment of the present invention, the metal ductile coating comprises: stainless steel a strong, ductile, highly adherent (to copper) metal whose oxides are emissive and are stable in the Zeus x-ray tube environment.

In another specific embodiment of the present invention, the ductile coating comprises: stainless steel coating from about 0.25 to about 5.0 mils thick.

One other aspect of the present invention includes a method of manufacturing the x-ray tube rotor used in certain x-ray tube.

Accordingly, an object of the present invention is to provide an x-ray system including an improved x-ray tube having increased scan life.

Another object of the present invention is to provide an improved x-ray tube having a scan life of at least 40,000 scan-seconds.

A further object of the present invention is to provide an x-ray tube having an improved rotor coating, resistant to flaking.

A still further object of the present invention is to provide an emissive coating for an x-ray tube rotor that will prevent flaking for at least 40,000 scan-seconds.

Other objects and advantages of the invention will be apparent from the following description, the accompanying drawings and the appended claims.

DESCRIPTION OF THE PREFERRED EMBODIMENT

Figure 1A:
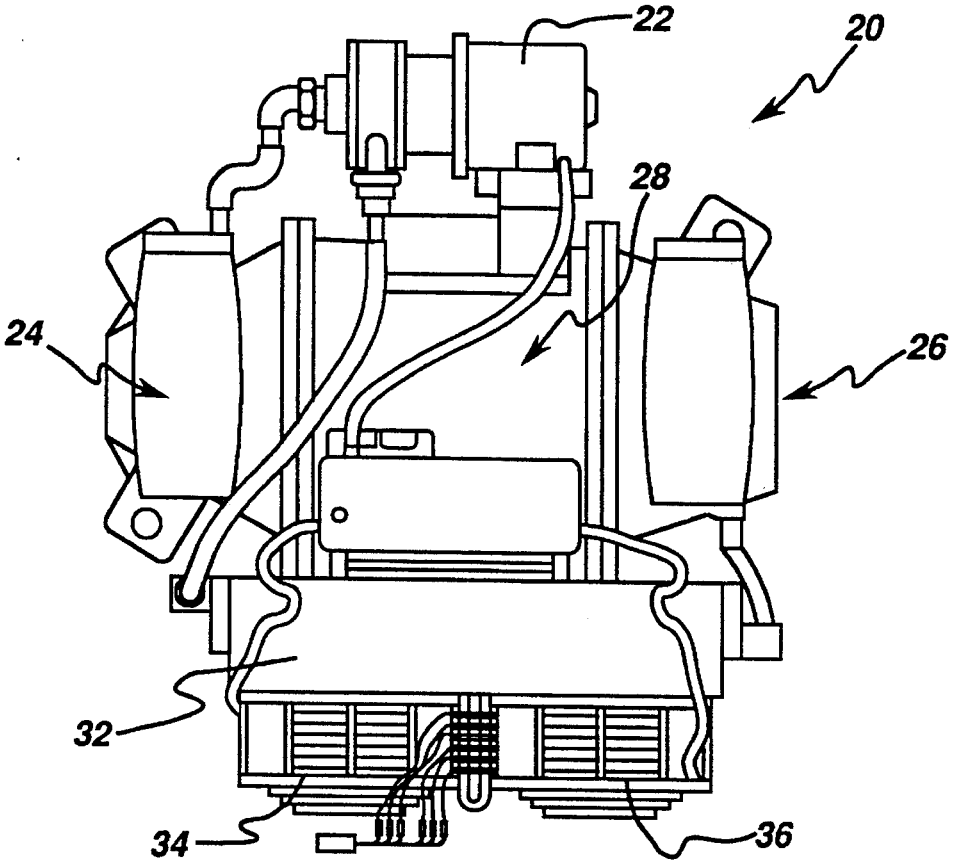
FIG. 1*a* is a plan view of a representative x-ray system having an x-ray tube positioned therein.
Figure 1B:
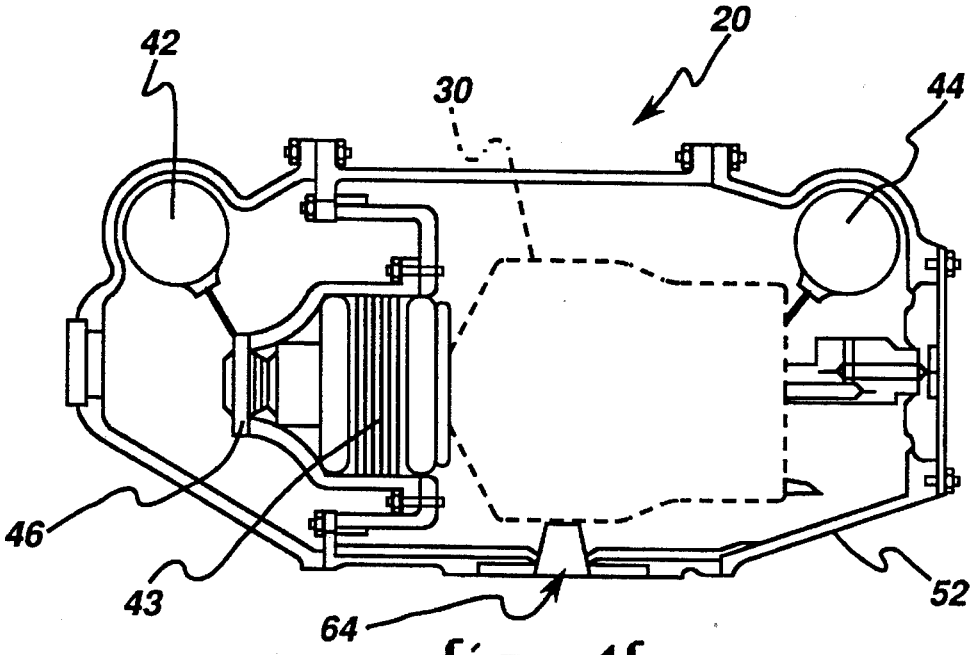
FIG. 1*b* is a sectional view with parts removed of the x-ray system of FIG. 1*a;*

An x-ray system embodying the present invention in one preferred form thereof is illustrated as generally designated by the numeral 20 in FIGS. 1*a,* 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b,* electrical connections are provided in the anode receptacle 42 and the cathode receptacle 44.

Figure 2:
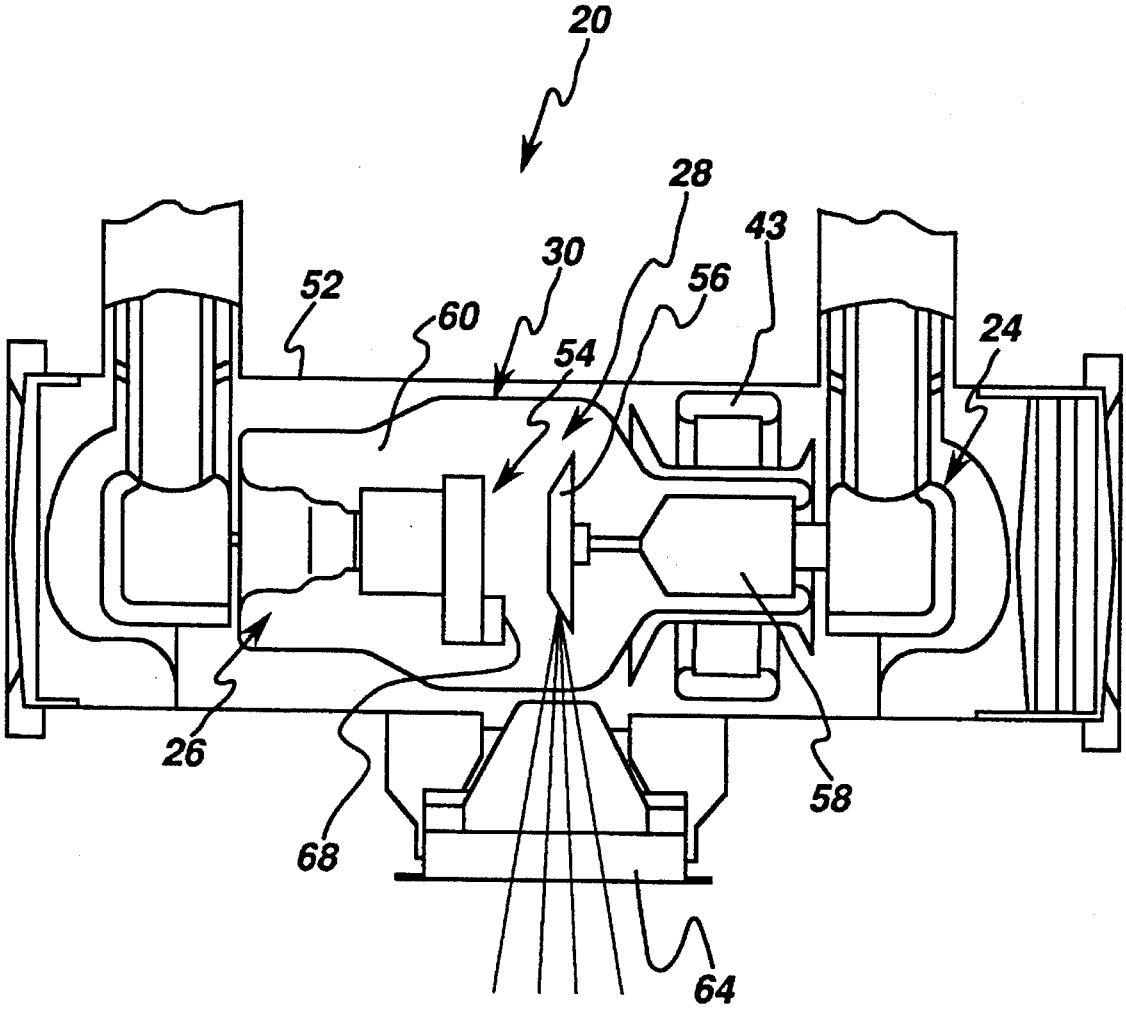
FIG. 2 is a schematic representation of another representative x-ray system.

As shown in FIG. 2, the x-ray system 20 comprises a casing 52 preferably made of aluminum and lined with lead and a cathode plate 54, a rotating target disc 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target disc 56 for allowing generated x-rays to exit the x-ray system 20.

As stated above, very high voltages and currents are utilized in certain GE systems and range from an approximate voltage maximum 120 KV to an approximate minimum of 80 KV and from an approximate current maximum of 400 ma to an approximate minimum of 250 ma.

Figure 3:
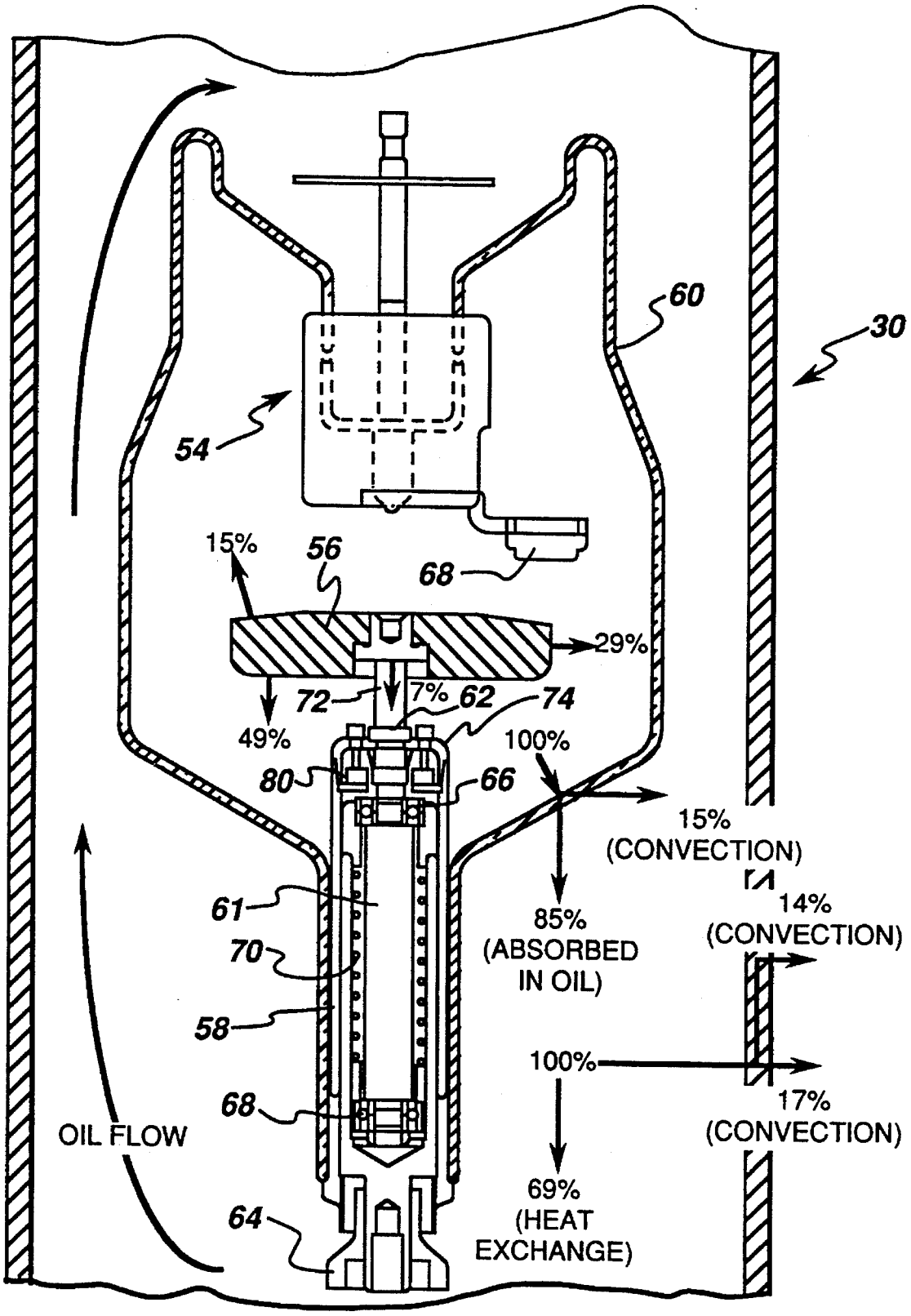
FIG. 3 is a partial sectional view of an x-ray tube illustrating representative thermal paths.
Figure 4:
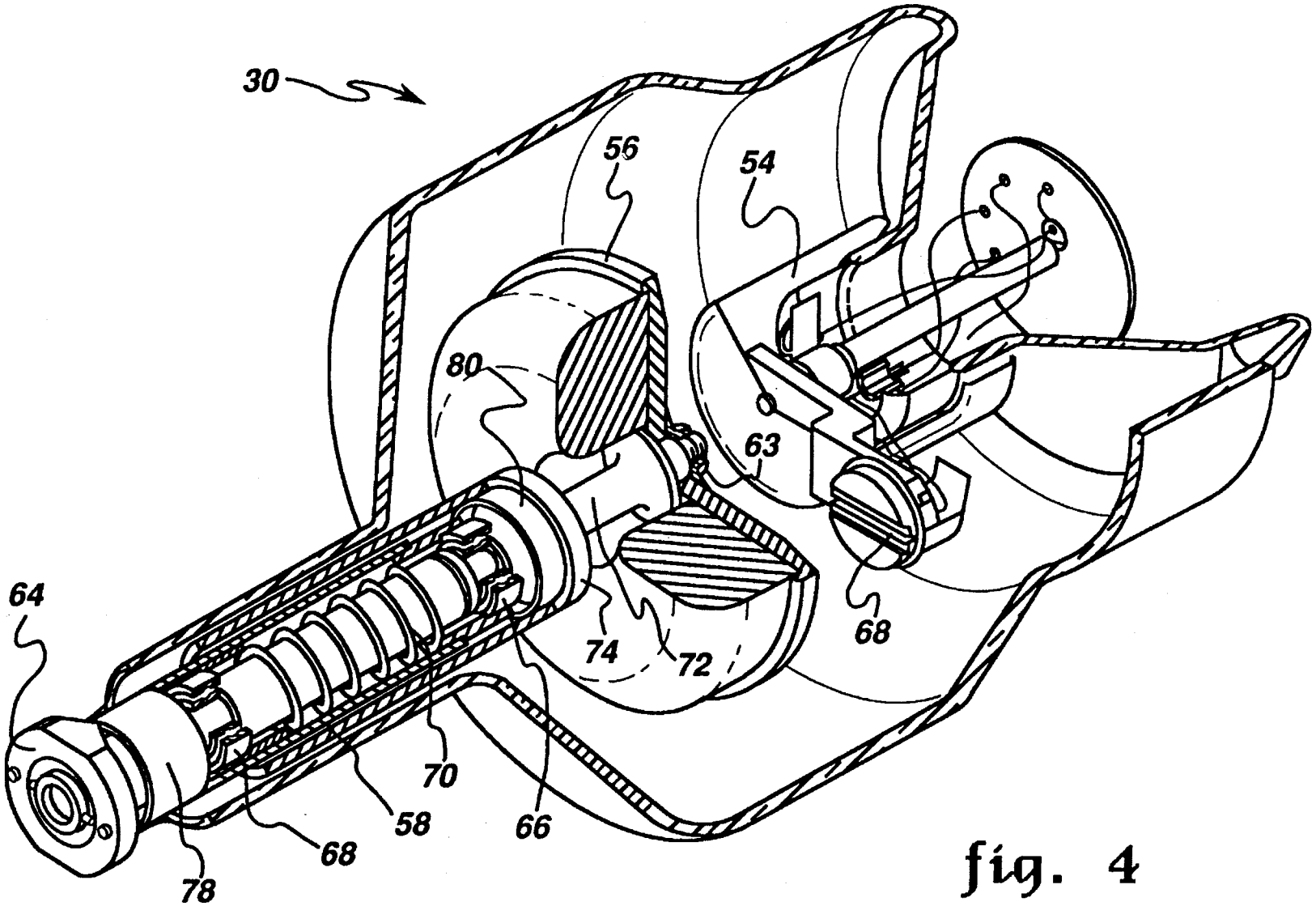
FIG. 4 is a partial perspective view of a representative x-ray tube with parts removed, parts in section, and parts broken away.

As shown in FIGS. 3 and 4, the cathode 54 is positioned inside the glass envelope 60. As is well known, inside the glass envelope 60 there is a vacuum of about $10^{-5}$ to about $10^{-9}$ torr. The electricity generates x-rays that are aimed from the cathode filament 68 to the anode target or the top of the target disc 56. The target disc is operatively connected to a rotating shaft 61 at one end by a Belleville nut 62 and by another nut at the other end 64. A front bearing 66 and a rear bearing 68 are operatively positioned on the shaft 61 and are held in position in a conventional manner. The bearings 66 and 68 are usually silver lubricated and are susceptible to failure at high operating temperatures.

A preload spring 70 is positioned about the shaft 60 between the bearings 66, 68 for maintaining load on the bearings during expansion and contraction of the anode assembly. A rotor stud 72 is utilized to space the end of the rotor most proximate the target 56 from the rotor hub 74. The bearings, both front 66 and rear 68, are held in place by bearing retainers 78 and 80. The rotor assembly also includes a stem ring and a stem all of which help to provide for the rotation of the rotor 58 with the target 56.

The temperature in the area of the filament 68 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approach 700° C. and of the front bearing approaches 450° C. maximum. Obviously, as one moves from the target 56 to the rotor 58 and stator 43, the temperature appears to decrease. It has recently been found that temperatures on the surface of the rotor 58 can approach up to 700° C.

During operation of some x-ray systems having certain x-ray tubes, severe protocols users have maximized usage of the system by making as many scans at high peak power in as short a time as possible. One of the problems with utilizing any x-ray system in this continuous type of operation is the amount of heat that is generated, which may in fact destroy the silver bearings 66, 68, especially the front bearing 66.

If the x-ray tube target 56 and rotor 58 were allowed to continue to rotate at 10,000 rpm between scans, the bearings would wear out prematurely and cause the tube to fail. Thus, if it appears that there would to be more than 60 seconds between scans, the x-ray system operating control system software is programmed to brake the rotor by rapidly slowing it completely down to zero (0) rpm. However, when ready to initiate a scan, the control system software is programmed to return the target and the rotor to 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the x-ray system applies maximum power to bring the target, or anode, to 10,000 rpm or down to zero (0) rpm in the least amount of time possible.

It should be noted that the x-ray tube target and rotor can be accelerated to 10,000 rpm from a dead stop in about 12 to about 15 seconds and slowed down at about the same rate. Vibration from the resonant frequencies is a real problem, if the tube is allowed to spin to a stop without braking.

It has been found that during these rapid accelerations to 10,000 rpm and the immediate barking from 10,000 rpm to zero, stresses, mechanical as well as thermal, impact on the rotor 58. These stresses have resulted in portions of the $TiO_2$ coating on the rotor surface flaking in the portion of the rotor must proximate the stator where motor losses and heating are greatest. These fine particles or flakes have been found to be attracted to high electrical fields, such as the cathode 54 and to adhere electrostatically thereto.

Due to these flakes being attracted to the cathode 54, problems have developed relating to the disturbances caused by high voltage arcing, which are initiated from negative areas that have resulted in the necessity to repeat the scans when such arcing and instabilities occur during an x-ray scan.

As is well known, the surface of the cathode 54 in an x-ray tube 30 is designed to be extremely smooth and have no jutting components because if one point is even slightly higher than another, high electric fields result which can arc from the high point. This particular phenomenon is the reason the flaking of the coating of the rotor 58 and its migration to the high electrical field regions of the x-ray tube 30 and, in particular, the cathode 54 have resulted in a high incidence of GE Zeus x-ray tube failures (approximately 60%). Thus, there is a need for a rotor that has a coating having acceptable emissivity that prevents the flaking during severe protocols usage.

Figure 6:
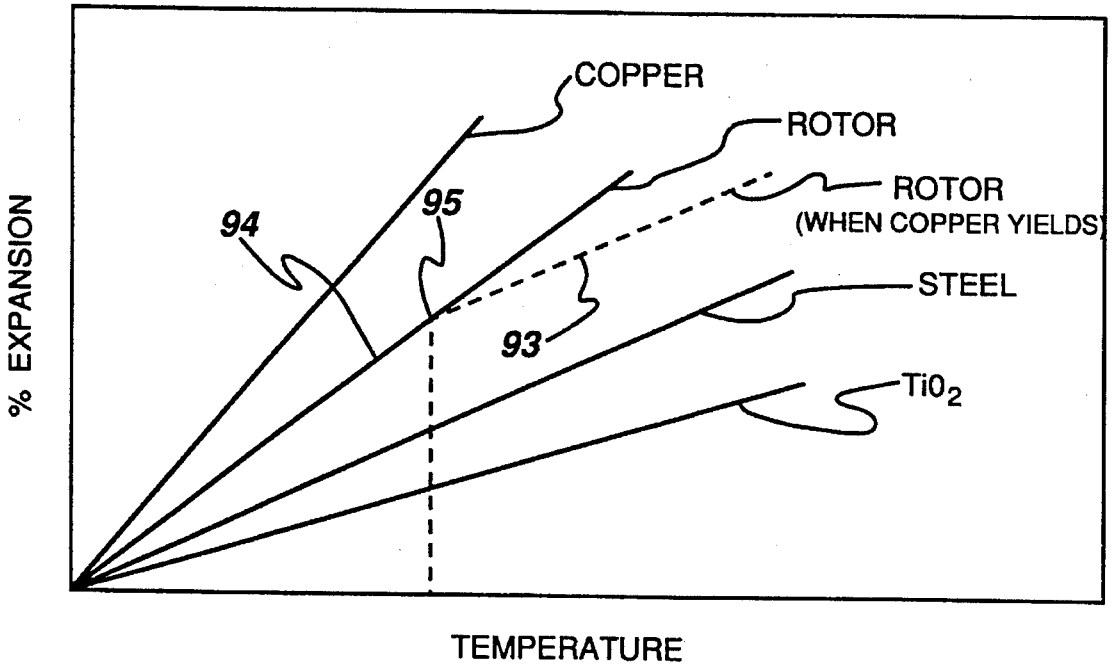
FIG. 6 is a graphic representation of the approximate thermal expansion of representative materials used in x-ray tube rotors.

One additional key to the stability of the rotor and especially to the prevention of coating flaking during severe protocols usage is the relative coefficient of expansion between the steel, the copper and the coating. As shown in FIG. 6, copper has a thermal expansion factor of about $18\times10^{-6}$ $K^{-1}$ and steel has a thermal expansion factor of about $12\times10^{-6}$ $K^{-1}$. The previously used $TiO_2$ coating had a thermal expansion of about $8\times10^{-6}$ $K^{-1}$ that is approximately one-half of copper.

It had been found that field Zeus x-ray tube rotors had ruptured outer surfaces that were initially believed to have led to the flaking of the $TiO_2$ coating. In order to overcome these initial flaking problems, which appeared to be related to the rupture of the copper outer surfaces, a specific copper alloy was used called GLIDCOP™, a trademark of the SCM Corp., (oxide dispersion strengthened copper). GLIDCOP™ has about ninety-two percent of the electrical and thermal properties of copper and has about the same thermal expansion as copper, but has 8–10 times the yield strength of copper.

FIG. 6 illustrates the expansion of the regular copper combined with the steel. Specifically, at the point where line 94 splits into line 93, is the temperature where stress in the copper exceeds its yield point, thus the rotor with the normal copper yields and its thermal expansion coefficient is equivalent to line 93 as temperature rises. When using copper with GLIDCOP™, represented by line 94 beyond the point 95, it is believed the copper with GLIDCOP™ has a relatively high thermal expansion coefficient because the GLIDCOP™ does not yield like copper. The utilization of the GLIDCOP™ appears to solve the x-ray tube rotor ruptured outer surface problem but, in fact, made the $TiO_2$ coating flaking worse. Since the effective expansion of the copper-steel is lower than the effective GLIDCOP™-steel thermal expansion because the GLIDCOP™ does not yield during tube operations, as indicated in FIG. 6, the $TiO_2$ coating flaking problem was made worse by the GLIDCOP™-steel combination.

Figure 5:
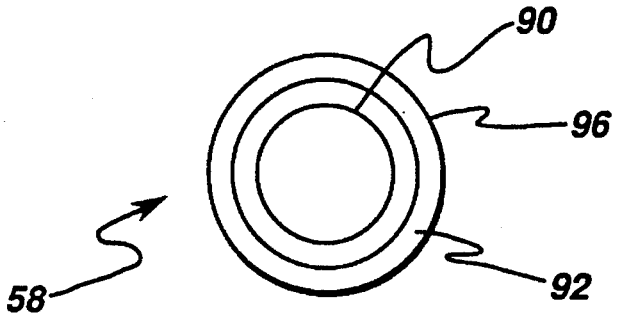
FIG. 5 is a sectional view of an x-ray tube rotor showing the composition thereof.

With specific reference now to FIG. 5, the rotor 58 of the present invention, in one form thereof, preferably comprises a 1018 steel inner member 90 having a copper outer member 92 operatively connected thereto by means such as brazing. It should be understood that, while FIG. 5 shows the steel as being relatively thicker than the copper, the steel and copper components, as actually used, are preferably approximately the same thickness.

In order to manufacture the rotor, a hollow steel cylinder member, such as 1018 steel, is electroplated with gold-copper braze. A complementary hollow copper member is positioned over the steel cylinder with the outer surface of the steel and inner surface of the copper cylinders touching. The combined cylinders are placed in a TZM Molybdenum dye to constrain the expansion of the outer copper so that the copper and steel maintain contact during high temperature brazing, usually done in a vacuum.

After rotor machining, the outer surface of the copper member 92 is coated with a thermal emissive coating 96 for radiating excessive heat from the rotor, such that the rotor 58 is prevented from flaking or spalling during extreme protocols operation.

It has been discovered that partially oxidized air plasma sprayed iron coatings on flat copper substrates have emissivities ranging from 0.76 to about 0.90 when not reduced by hydrogen. Cyclic testing was conducted using both the air plasma sprayed iron and $TiO_2$. The $TiO_2$ coated material flaked while the iron coated material did not.

Iron forms a ductile, metallic coating and thus should not spall from copper x-ray tube rotors during the thermal cycle associated with tube operations. Since iron is not very expensive and most likely presents fewer production processing problems than Rene' 80 (as disclosed in the above mentioned application), it is believed that iron may be the more advantageous material. Although the expansion coefficient of iron (about $12\times10^{-6}$ $K^{-1}$) is about ⅓ lower than cooper (about $18\times10^{-6}$ $K^{-1}$), it is believed that the ductility and expansion of iron are sufficient to prevent rotor coating spalling. In general, iron is more ductile than Rene' 80 while $TiO_2$ is not ductile at all.

EXAMPLE 1

Flat copper substrates were grit blasted with 60 mesh aluminum oxide. The emissivity of grit blasted copper is about 0.2 to about 0.3. The substrates were ultrasonically cleaned and degreased in methyl chloroform solvent for ten minutes. The substrates were air plasma sprayed with 1–5 μm electrolytic iron, obtained from Atlantic Equipment Engineers.

The emissivity of the iron coating was measured by heating the substrate to about 150°–200° C. on a hot plate.

On one side of the sample a piece of black electrical tape (emissivity of about 0.96) was attached, which served as a reference surface. We observed the radiation emitted from the coating and the electrical tape using an Agena Thermovision Model 970 SW/TE IR imaging camera. The spectral response of the camera is about 2.0–5.6 μm.

The emissivity was calculated by dividing the photon flux of the radiation emitted from the electrical tape into the photon flux of the radiation emitted from the coating and multiplying the result by the emissivity of the electrical tape (0.96). For reference purposes, the emissivity of a $TiO_2$ coating was measured on copper fabricated at a first location and a Rene' 80 coating on copper fabricated at GE Corporate Research & Development. Table 3 gives the emissivity values determined at GE Corporate Research & Development and the first location.

TABLE 1

Emissivity of Air Plasma Sprayed Metal Coatings on Flat Copper Substrates

| Material | Emissivity (CRD Measured) (2.0–5.6 μm) | Emissivity (1st location Measured) (2.0 μm) |
|---|---|---|
| GEMS plasma sprayed $TiO_2$ | 0.86 | 0.85 |
| Rene' 80 –400 mesh | 0.73 | 0.73 |
| Iron (1–5 μm powder) | 0.76 | 0.76 |

The data in the table above shows that the plasma sprayed iron has a slightly higher emissivity than the Rene' 80, but lower than the $TiO_2$.

Two Zeus x-ray tube rotors were then sprayed with the iron. The rotors were heat treated for about 4 hours at 720° C. and 4 hours at 620° C. in vacuum. After heat treatment, the color of the iron coatings did not change, suggesting that the emissivity did not change.

EXAMPLE 2

Since the high emissivity of a plasma sprayed ductile metal (Rene' 80) was a surprise, the emissivities of other plasma sprayed metallic materials were evaluated. Since previous data indicated that the finer powder sizes yielded higher emissivities for Rene' 80, work was confined to powders finer than 400 mesh (<37 μm). The coatings were deposited on flat OFHC copper substrates. Some fine metallic iron was sprayed and the emissivities of the candidate coatings measured using an IR camera. Table 2 shows the results of these determinations. Also shown in Table 2 are the emissivities of the $TiO_2$ coating and the –400 mesh Rene' 80 measured on flat specimens.

TABLE 2

Emissivity (2.0–5.6 μm) of Air Plasma Sprayed Metal Coatings on Flat Copper Substrates

| Material | Emissivity (CRD Measured) | Emissivity (1st Location Measured) |
|---|---|---|
| Plasma sprayed $TiO_2$ | 0.86 | 0.85 |
| Rene' 80 –400 mesh | 0.73 | 0.73 |
| IN-718 | 0.81 | 0.81 |
| IN-761 | 0.86 | 0.82 |
| Iron | 0.80 | 0.76 |
| IN-100 | 0.68 | 0.69 |
| RD8AH | 0.53 | 0.50 |

TABLE 2-continued

Emissivity (2.0–5.6 μm) of Air Plasma Sprayed Metal Coatings on Flat Copper Substrates

| Material | Emissivity (CRD Measured) | Emissivity (1st Location Measured) |
|---|---|---|
| Rene' 120 | 0.70 | 0.69 |
| 316 stainless steel | 0.81 | 0.80 |

It can be seen from the table that all but three of the plasma sprayed coatings had emissivities greater than the Rene' 80. This result suggests that the emissivity of plasma sprayed nickel base alloys is not sensitive to composition and the emissivity may be more a result of the rough plasma sprayed and partially oxidized surface. It was determined that the naked eye could rank the emissivities of the coatings. The darker coatings had the higher measured emissivity. To check our results, the samples were sent for emissivity determination using a spectrophotometer.

The plasma sprayed iron appeared particularly attractive because its use has few, if any, known production facility concerns. Consequently, two rotors were sprayed with iron and vacuum heat treated. There were two concerns about the use of iron as an emissive coating. One concern was that the magnetic iron will interfere with the operation of the motor. One knowledgeable person consulted did not believe a 0.001–0.003 inch thick iron coating would significantly affect motor operation. A second concern was that the high emissivity of iron may be due to the presence of an iron oxide that could be reduced during heat treatment or tube operation. Vacuum heat treatments should indicate whether this is a problem. The emissivity of the iron coated rotors will be re-measured after heat treatment. If no problems are found, the iron coated rotors could be assembled in a Zeus tube and evaluated by oil box or gantry tests.

EXAMPLE 3

The emissivities of other plasma sprayed metallic materials using powders finer than 400 mesh (<37 μm) has been evaluated. As a check on the emissivity measurements, the emissivity was remeasured using a spectrophotometer. Table 3 shows the results of these measurements. The first location values were comparable to the CRD values considering that the CRD measurements used IR radiation ranging from 2.0–5.6 μm as compared to 2.0 μm radiation used by the first location.

The goal was to determine whether compositional differences affected the emissivity of the coatings. There appeared to be a good correlation between aluminum content in an alloy and its emissivity. Higher aluminum levels resulted in lower emissivity. The 316 stainless steel, IN-761, and the iron have no aluminum and they have the highest emissivities. The IN-718 only has 0.6% aluminum. The RD-8AH and IN-100 have 5.5% aluminum and the lowest emissivities. The Rene' 80 and Rene' 120 have 3.0 and 4.8 percent aluminum, respectively.

TABLE 3

Emissivity of Air Plasma Sprayed Metal Coatings on Flat Copper Substrates

| Material | Emissivity (CRD Measured) (2.0–5.6 μm) | Emissivity (1st Location Measured) (2.0 μm) |
|---|---|---|
| Plasma sprayed $TiO_2$ | 0.86 | 0.85 |
| Rene' 80 –400 mesh | 0.73 | 0.73 |
| IN-718 | 0.81 | 0.81 |
| IN-761 | 0.86 | 0.82 |
| Iron | 0.80 | 0.76 |
| IN-100 | 0.68 | 0.69 |
| RD8AH | 0.53 | 0.50 |
| Rene' 120 | 0.70 | 0.69 |
| 316 stainless steel | 0.81 | 0.80 |

As previously described, the plasma sprayed iron is particularly attractive as an alternative to the nickel and chromium bearing emissive coatings because it has fewer internal processing concerns. A total of five (5) rotors were sprayed with iron and then vacuum heat treated.

After vacuum heat treatment, it was determined that the emissivity of one iron coated rotor was 0.77, which compares favorably to the values in Table 3. One of the iron rotors was cycled six times in a cycling rig. It was observed that, with each successive cycle, the peak rotor temperature increased for a constant power input. This suggested that the emissivity of the iron coated rotor was decreasing after each cycle. When the iron coated rotor was removed from the test it was observed that the coating was adherent, but had a "milky white" color. This suggests that the original coating had some iron oxide present, which was reduced to iron in the high temperature hydrogen atmosphere of his test apparatus.

This result does not mean that the iron coating is unsuitable in a tube environment. The hydrogen atmosphere of the test apparatus may have a lower partial pressure of oxygen than does a Zeus tube. The stability of iron oxides is a strong function of temperature. During tube operation, the temperature of the rotor probably does not exceed 800° C. We will cycle one of the iron rotors in the CRD apparatus in vacuum to determine if its emissivity decreases with thermal cycling. One conclusion that can be drawn from these observations is that plasma sprayed iron coatings are less stable than Rene' 80 coatings. No color changes were observed for Rene' 80 coated rotors under the same conditions.

To verify the above result, an iron coated rotor was evaluated in the CRD thermal cycling rig. At CRD the environment is vacuum, not hydrogen. After plasma deposition and vacuum heat treatment the emissivity of the iron rotor was measured and found to be 0.80. The rotor was heated to 930° C. and cooled to about 100° C. six times in a vacuum of $10^{-7}$ torr. The cooling curve of the rotor was monitored during each cycle to determine if there was any change in emissivity. No apparent change in emissivity was noted. This was confirmed by later emissivity measurements. After cycling, the rotor was removed from the apparatus and examined. There was no evidence of any spallation or cracking of the iron coating.

These results suggest that iron oxides contribute to the emissivity of the plasma sprayed iron emissive coating. Chromium oxide may also be contributing to the emissivity of the Rene' 80 and the stainless steel. Wustite (FeO) in equilibrium with elemental iron at 930° C. has an oxygen partial pressure of about $10^{-16}$ atmospheres (about $10^{-13}$ torr). This is considerably lower than the expected oxygen partial pressure in the CRD vacuum thermal cycling rig. If the hydrogen atmosphere in the first location thermal cycling rig was sufficiently dry, it is probable that the oxygen partial pressure was below that of the wustite. Under those conditions the iron oxides would decompose to form elemental iron. Based on the CRD thermal cycling results, it is expected that the iron emissive coatings would probably be stable in the tube environment.

It should be obvious from the above that a thermal emissive coating on the rotor consisting of air plasma sprayed iron coatings are superior in the prevention of flaking over the previously used $TiO_2$ coatings.

It is believed that any coating having ductility (i.e., strain to fail) greater than 0.05%, a close thermal expansion match to copper and steel (or to whatever metals are used in the rotor), a stable oxide in an x-ray tube environment (such as FeO, $Cr_2O_3$, $Al_2O_3$) and which have an emissivity of about 0.6 to about 1.00 will function such that rotor coating flaking will occur, if at all, only after at least 40,000 scan-seconds of usage.

While the methods and products contained herein constitute preferred embodiments of the invention, it is to be understood that the invention is not limited to these precise methods and products, and that changes may be made therein without departing from the scope of the invention which is defined in the appended claims.

What is claimed is:

1. An x-ray tube comprising:

a glass envelope;

a cathode, operatively positioned in the glass envelope;

an anode assembly operatively positioned in the envelope, the anode assembly including a rotor operatively positioned relative to a stator; and a target, operatively positioned relative to the cathode, the rotor comprising:

a metal inner core;

a metal outer core; and a ductile, metal coating having a stable, adherent oxide selected from the group consisting of: Fe, Cr, Al or Ni, operatively positioned on the outer surface of the outer core.

2. The x-ray tube of claim 1 wherein the ductile metal coating is iron.

3. The x-ray tube of claim 1, wherein the ductile metal coating has a strain to fail greater than 0.05%.

4. The x-ray tube of claim 1, wherein at least about 40,000 x-ray scan-seconds are completed prior to failure by rotor spalling.

5. The x-ray tube of claim 1, wherein the ductile metal coating contains less than about 6.0% aluminum.

6. The x-ray tube of claim 1, wherein the ductile metal coating contains less than about 5.0% aluminum.

7. The x-ray tube of claim 1, wherein the ductile metal coating contains less than about 0.7% aluminum.

8. The x-ray tube of claim 2, wherein the ductile, iron coating has a stable oxide and an emissivity of about 0.6 to about 0.98.

9. The x-ray tube of claim 2, wherein the rotor is coated with iron from about 0.2 to 5.0 mils thick.

10. The x-ray tube of claim 1, wherein the inner core has a thermal expansion similar to steel.

11. The x-ray tube of claim 1, wherein the outer core has a thermal expansion similar to copper.

12. The x-ray tube of claim 1, wherein the ductile metal coating is selected from the group consisting of iron, In-718, In-761, In-100 and stainless steel.

13. An x-ray system comprising;

an enclosure having oil contained therein;

an oil pump, operatively positioned relative to the enclosure for circulating oil within the system;

at least one cooling means, operatively connected to the enclosure and the oil pump, for cooling the oil;

an x-ray tube, operatively positioned inside the enclosure, for generating and directing x-rays toward a target, the x-ray tube comprising:

a glass envelope;

a cathode, operatively positioned in the glass envelope;

a rotor;

a stator, operatively positioned relative to the rotor; and a target, operatively positioned relative to the cathode and operatively connected to the rotor, the rotor comprising:

a metal inner core;

a metal outer core; and a ductile, metal coating having a stable, adherent oxide selected from the group consisting of: Fe, Cr, Al or Ni, operatively positioned on the outer surface of the outer core.

14. The x-ray system of claim 13, wherein the ductile, metal coating has a strain to fail greater than 0.05%.

15. The x-ray system of claim 13, wherein the ductile, metal coating has a stable oxide and an emissivity of about 0.6 to about 0.98.

16. The x-ray system of claim 13, wherein the ductile iron coating is applied to the rotor outer core outer surface from about 0.2 to about 5.0 mils thick.

17. The x-ray system of claim 13, wherein at least about 40,000 scan-seconds are accomplished prior to tube failure due to rotor coating spalling.

18. A method of manufacturing a rotor for an x-ray tube comprising the steps of:

providing a metal inner core;

providing a metal outer core;

operatively connecting the outer core to the inner core; and applying a ductile, metal coating having a stable, adherent oxide selected from the group consisting of: Fe, Cr, Al or Ni on the outer surface of the outer core.

19. The method of claim 18, wherein at least about 40,000 x-ray scan-seconds are accomplished prior to failure from coating flaking.

20. The method of claim 18, wherein the ductile metal coating contains less than about 6.0% aluminum.

21. The method of claim 18, wherein the ductile metal coating contains less than about 0.7% aluminum.

22. The method of claim 18, wherein the ductile metal coating contains less than about 5.0% aluminum.

23. The method of claim 18, wherein the ductile metal coating is selected from the group consisting of iron, In-718, In-761, In-100 and stainless steel.

24. The method of claim 18, wherein the ductile, metal coating has a strain to fail greater than 0.05%.

25. The method of claim 18, wherein the ductile, metal coating has a stable oxide and an emissivity of about 0.6 to about 0.98.

26. The method of claim 18, wherein the ductile, metal coating is applied to the rotor outer core outer surface from about 0.2 to about 5.0 mils thick.

27. The method of claim 18, wherein the ductile, metal coating is applied to rotors utilized in an x-ray system operating at voltages from about 80 KV to about 120 KV.

28. The method of claim 18, wherein at least about 40,000 scan-seconds are accomplished prior to tube failure due to rotor coating spalling.

29. An x-ray tube comprising:

an envelope;

a cathode, operatively positioned in the envelope;

an anode assembly, operatively positioned in the envelope, the anode assembly including a rotor, operatively positioned relative to a stator, and a target, operatively positioned relative to the cathode, the rotor comprising:

an inner core;

an outer core; and a ductile, metal coating having a stable, adherent oxide selected from the group consisting of: Fe, Cr, Al or Ni, operatively positioned on the outer surface of the outer core.

30. An x-ray system comprising;

an enclosure;

at least one cooling means, operatively connected to the enclosure, for cooling the system;

an x-ray tube, operatively positioned inside the enclosure, for generating x-rays, the x-ray tube comprising:

an envelope;

a cathode, operatively positioned in the envelope;

an anode assembly, operatively positioned in the envelope, the anode assembly including a rotor, operatively positioned relative to a stator and a target, operatively positioned relative to the cathode, the rotor comprising:

an inner core;

an outer core; and a ductile, metal coating having a stable, adherent oxide selected from the group consisting of: Fe, Cr, Al or Ni, operatively positioned on the outer surface of the outer core.

31. A method of manufacturing a rotor for an x-ray tube comprising the steps of:

providing an inner core;

providing an outer core;

operatively connecting the outer core to the inner core; and applying a ductile, metal coating having a stable, adherent oxide selected from the group consisting of: Fe, Cr, Al or Ni on the outer surface of the outer core.

* * * * *